US011913286B2

(12) United States Patent
Morin

(10) Patent No.: US 11,913,286 B2
(45) Date of Patent: Feb. 27, 2024

(54) EARTH-BORING TOOLS WITH THROUGH-THE-BLADE FLUID PORTS, AND RELATED METHODS

(71) Applicant: Baker Hughes Oilfield Operations LLC, Houston, TX (US)

(72) Inventor: John Morin, The Woodlands, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 33 days.

(21) Appl. No.: 17/342,301

(22) Filed: Jun. 8, 2021

(65) Prior Publication Data

US 2022/0389765 A1 Dec. 8, 2022

(51) Int. Cl.
*E21B 10/61* (2006.01)
*E21B 10/18* (2006.01)
*E21B 10/42* (2006.01)

(52) U.S. Cl.
CPC ..... *E21B 10/61* (2013.01); *E21B 10/18* (2013.01); *E21B 10/42* (2013.01)

(58) Field of Classification Search
CPC ..... E21B 10/18; E21B 10/61; E21B 10/60; E21B 10/602
See application file for complete search history.

(56) References Cited

U.S. PATENT DOCUMENTS 1,945,258 A * 1/1934 Collins ..... E21B 10/18 175/345
2,096,132 A * 10/1937 Pearce ..... E21B 10/42 175/435
2,710,741 A * 6/1955 Hall, Sr. ..... E21B 21/00 166/99
3,645,346 A * 2/1972 Miller ..... E21B 10/60 175/231
4,083,417 A * 4/1978 Arnold ..... E21B 10/18 175/339
4,452,324 A * 6/1984 Jurgens ..... E21B 10/602 299/81.3
4,883,132 A 11/1989 Tibbitts
(Continued)

FOREIGN PATENT DOCUMENTS

WO 2011/011259 A1 1/2011

OTHER PUBLICATIONS

Dictionary definition of "manifold", accessed Jul. 25, 2022 via thefreedictionary.com.*

(Continued)

*Primary Examiner* — Blake Michener
(74) *Attorney, Agent, or Firm* — TraskBritt

(57) ABSTRACT

An earth-boring tool may include a blade having a face surface, a cutting edge, and a rotationally leading surface. The earth-boring tool may additionally include at least one fluid port extending through the blade, and a fluid port manifold having an opening at a first end and a plurality of openings along a length providing fluid communication between the at least one fluid port and a primary fluid passage of the earth-boring tool. An additional earth-boring tool may include a fluid port manifold located in the tool body and a plurality of fluid port sleeves, each fluid port sleeve of the plurality of fluid port sleeves extending into a corresponding opening of a plurality of openings along the length of the fluid port manifold.

24 Claims, 6 Drawing Sheets

(56) References Cited

U.S. PATENT DOCUMENTS

| | | | | |
|---|---|---|---|---|
| 5,294,059 | A * | 3/1994 | Willan | E21B 10/60 239/224 |
| 5,316,095 | A * | 5/1994 | Tibbitts | E21B 10/61 175/429 |
| 6,142,248 | A * | 11/2000 | Thigpen | E21B 10/61 175/339 |
| 6,527,065 | B1 * | 3/2003 | Tibbitts | E21B 10/43 175/339 |
| 10,107,039 | B2 | 10/2018 | Schroder | |
| 10,337,257 | B2 | 7/2019 | Zhang et al. | |
| 2008/0035388 | A1 * | 2/2008 | Hall | E21B 10/602 175/429 |
| 2008/0236899 | A1 * | 10/2008 | Oxford | E21B 10/18 175/339 |
| 2010/0270086 | A1 * | 10/2010 | Matthews, III | E21B 10/60 175/425 |
| 2011/0061941 | A1 * | 3/2011 | Twardowski | E21B 10/61 175/393 |
| 2012/0228033 | A1 | 9/2012 | Mazarac | |
| 2016/0326810 | A1 | 11/2016 | Clausen | |
| 2018/0371872 | A1 | 12/2018 | Felten et al. | |
| 2019/0338598 | A1 | 11/2019 | Hahn et al. | |

OTHER PUBLICATIONS

International Search Report for International Application No. PCT/US2022/071151 dated Jun. 30, 2022, 3 pages.

International Written Opinion for International Application No. PCT/US2022/071151 dated Jun. 30, 2022, 5 pages.

* cited by examiner

EARTH-BORING TOOLS WITH THROUGH-THE-BLADE FLUID PORTS, AND RELATED METHODS

TECHNICAL FIELD

The present disclosure relates to earth-boring tools containing through-the-blade fluid ports and related methods of making such earth-boring tools.

BACKGROUND

Many different tools used in the oil exploration and production industry utilize bodies or components comprising steel which are exposed to very abrasive and erosive environments. For example, subterranean drilling operations generally employ a rotary drill bit that is rotated while being advanced through rock formations. Cutting elements or structures affixed to the rotary drill bit cut the rock while drilling fluid removes formation debris and carries it back to the surface. The drilling fluid is pumped from the surface through the drill string and out through one or more (usually a plurality of) nozzles located in junk slots of the drill bit. The nozzles direct jets or streams of the drilling fluid to clean and cool cutting surfaces of the drill bit and for the aforementioned debris removal.

The life of a drill bit having PDC cutting elements is typically extended when it is adequately lubricated and cooled during the drilling process. In contrast, having inadequate drilling fluid flow to the face of a drill bit allows formation cuttings to collect on the faces of the cutting elements. This collection of cuttings isolates the cutting elements from the drilling fluid. This also reduces the rate of penetration of the drill bit and if the debris collection is sufficiently high the cutting elements may overheat which increases the wear rate. Adequate and continuous fluid flow is critical to the success of the drill bit. However, repeated exposure to solids-laden drilling fluid may cause severe abrasion and erosion on the interior of the drill bit and nozzles on the bit face exposed to the fluid flow. Excessive abrasion and erosion may lead to complete failure of the drill bit. Accordingly, there exists a continuing need for developments to improve the fluid flow for drill bits and, especially for steel drilling tool bodies, to improve the erosion and/or wear resistance of the tool body.

BRIEF SUMMARY

Some embodiments of the present disclosure include earth-boring tools including at least one blade having a face surface, a cutting edge, and a rotationally leading surface. The earth-boring tool may additionally include at least one fluid port extending through the at least one blade, and a fluid port manifold having an opening at a first end and a plurality of openings along a length providing fluid communication between the at least one fluid port and a primary fluid passage of the earth-boring tool.

Some embodiments of the present disclosure include an earth-boring tool comprising a tool body having at least one fluid port manifold located in the tool body and having an opening at a first end in fluid communication with a primary fluid passage, and a plurality of openings along a length of the at least one fluid port manifold. The earth-boring tool may additionally include a plurality of fluid port sleeves, each fluid port sleeve of the plurality of fluid port sleeves extending into a corresponding opening of the plurality of openings along the length of the at least one fluid port manifold.

Some embodiments of the present disclosure include a method of forming an earth-boring tool, the method including disposing a fluid port manifold within an opening of a body of the earth-boring tool, the opening extending from an outer surface of the body to a primary fluid passage. The method may further include disposing at least one fluid port sleeve within at least one fluid port, the at least one fluid port extending through a blade of the body to an opening in the fluid port manifold.

DETAILED DESCRIPTION

Figure 1:
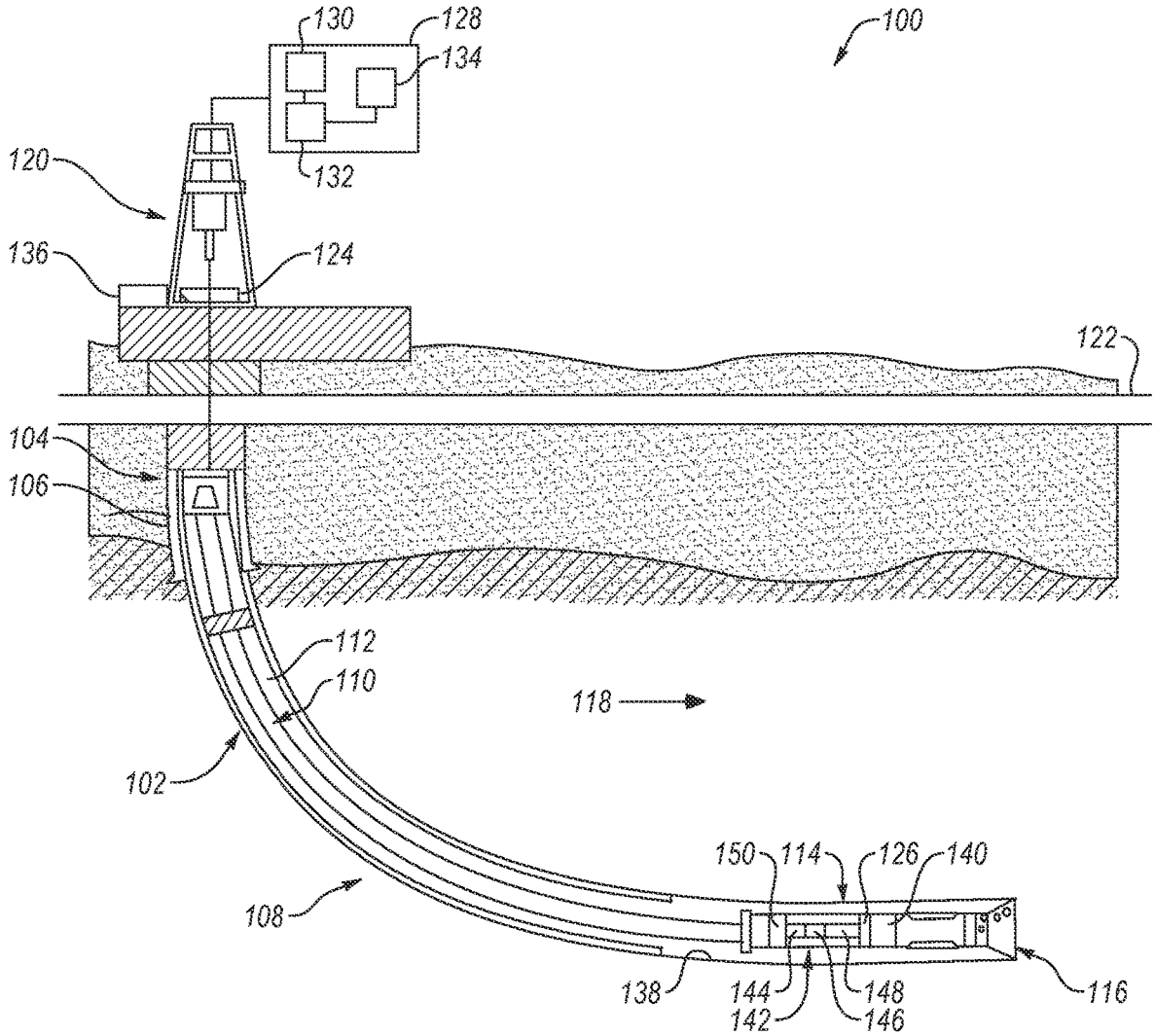
FIG. 1 is a schematic diagram of an example of a drilling system that may utilize the apparatuses and methods disclosed herein for drilling boreholes.

The illustrations presented herein are not meant to be actual views of any particular component, device, or system, but are merely idealized representations which are employed to describe embodiments of the present invention.

As used herein, the terms "earth-boring tool" means and includes earth-boring tools for forming, enlarging, or forming and enlarging a borehole. Non-limiting examples of earth-boring tools include fixed cutter (drag) bits, fixed cutter coring bits, fixed cutter eccentric bits, fixed cutter bi-center bits, fixed cutter reamers, expandable reamers with blades bearing fixed cutters, and hybrid bits including both fixed cutters and rotatable cutting structures (e.g., roller cones).

As used herein, the term "cutting elements" means and includes, for example, superabrasive (e.g., polycrystalline diamond compact or "PDC") cutting elements employed as fixed cutting elements, as well as tungsten carbide inserts and superabrasive inserts employed as cutting elements mounted to a body of an earth-boring tool.

As used herein, the singular forms following "a," "an," and "the" are intended to include the plural forms as well, unless the context clearly indicates otherwise.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, any relational term, such as "first," "second," "top," "bottom," "upper," "lower," etc., is used for clarity and convenience in understanding the disclosure and accompanying drawings, and does not connote or depend on any specific preference or order, except where the context clearly indicates otherwise. For example, these terms may refer to an orientation of elements of an earth-boring tool when disposed within a borehole in a conventional manner. Furthermore, these terms may refer to an orientation of elements of an earth-boring tool when as illustrated in the drawings.

As used herein, the term "and/or" includes any and all combinations of one or more of the associated listed items.

As used herein, the term "substantially" in reference to a given parameter, property, or condition means and includes to a degree that one of ordinary skill in the art would understand that the given parameter, property, or condition is met with a degree of variance, such as within acceptable tolerances. By way of example, depending on the particular parameter, property, or condition that is substantially met, the parameter, property, or condition may be at least 90.0 percent met, at least 95.0 percent met, at least 99.0 percent met, at least 99.9 percent met, or even 100.0 percent met.

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.).

FIG. 1 is a schematic diagram of an example of a drilling system 100 that may utilize the apparatuses and methods disclosed herein for drilling boreholes. FIG. 1 shows a borehole 102 that includes an upper section 104 with a casing 106 installed therein and a lower section 108 that is being drilled with a drill string 110. The drill string 110 may include a tubular member 112 that carries a drilling assembly 114 at its bottom end. The tubular member 112 may be made up by joining drill pipe sections or it may be a string of coiled tubing, for example. A drill bit 116 may be attached to the bottom end of the drilling assembly 114 for drilling the borehole 102 of a selected diameter in a formation 118.

The drill string 110 may extend to a rig 120 at surface 122. The rig 120 shown is a land rig 120 for ease of explanation. However, the apparatuses and methods disclosed equally apply when an offshore rig 120 is used for drilling boreholes under water. A rotary table 124 or a top drive may be coupled to the drill string 110 and may be utilized to rotate the drill string 110 and to rotate the drilling assembly 114, and thus the drill bit 116 to drill the borehole 102. A drilling motor 126 may be provided in the drilling assembly 114 to rotate the drill bit 116. The drilling motor 126 may be used alone to rotate the drill bit 116 or to superimpose the rotation of the drill bit 116 by the drill string 110. The rig 120 may also include conventional equipment, such as a mechanism to add additional sections to the tubular member 112 as the borehole 102 is drilled. A surface control unit 128, which may be a computer-based unit, may be placed at the surface 122 for receiving and processing downhole data transmitted by sensors 140 in the drill bit 116 and sensors 140 in the drilling assembly 114, and for controlling selected operations of the various devices and sensors 140 in the drilling assembly 114. The sensors 140 may include one or more of sensors 140 that determine acceleration, weight on bit, torque, pressure, cutting element positions, rate of penetration, inclination, azimuth formation/lithology, etc. In some embodiments, the surface control unit 128 may include a processor 130 and a data storage device 132 (or a computer-readable medium) for storing data, algorithms, and computer programs 134. The data storage device 132 may be any suitable device, including, but not limited to, a read-only memory (ROM), a random-access memory (RAM), a flash memory, a magnetic tape, a hard disk, and an optical disk. During drilling, a drilling fluid from a source 136 thereof may be pumped under pressure through the tubular member 112, which discharges at the bottom of the drill bit 116 and returns to the surface 122 via an annular space (also referred as the "annulus") between the drill string 110 and an inside sidewall 138 of the borehole 102.

The drilling assembly 114 may further include one or more downhole sensors 140 (collectively designated by numeral 140). The sensors 140 may include any number and type of sensors 140, including, but not limited to, sensors generally known as the measurement-while-drilling (MWD) sensors or the logging-while-drilling (LWD) sensors, and sensors 140 that provide information relating to the behavior of the drilling assembly 114, such as drill bit rotation (revolutions per minute or "RPM"), tool face, pressure, vibration, whirl, bending, and stick-slip. The drilling assembly 114 may further include a controller unit 142 that controls the operation of one or more devices and sensors 140 in the drilling assembly 114. For example, the controller unit 142 may be disposed within the drill bit 116 (e.g., within a shank 208 and/or crown 210 of a bit body of the drill bit 116). The controller unit 142 may include, among other things, circuits to process the signals from sensor 140, a processor 144 (such as a microprocessor) to process the digitized signals, a data storage device 146 (such as a solid-state-memory), and a computer program 148. The processor 144 may process the digitized signals, and control downhole devices and sensors 140, and communicate data information with the surface control unit 128 via a two-way telemetry unit 150.

Figure 2A:
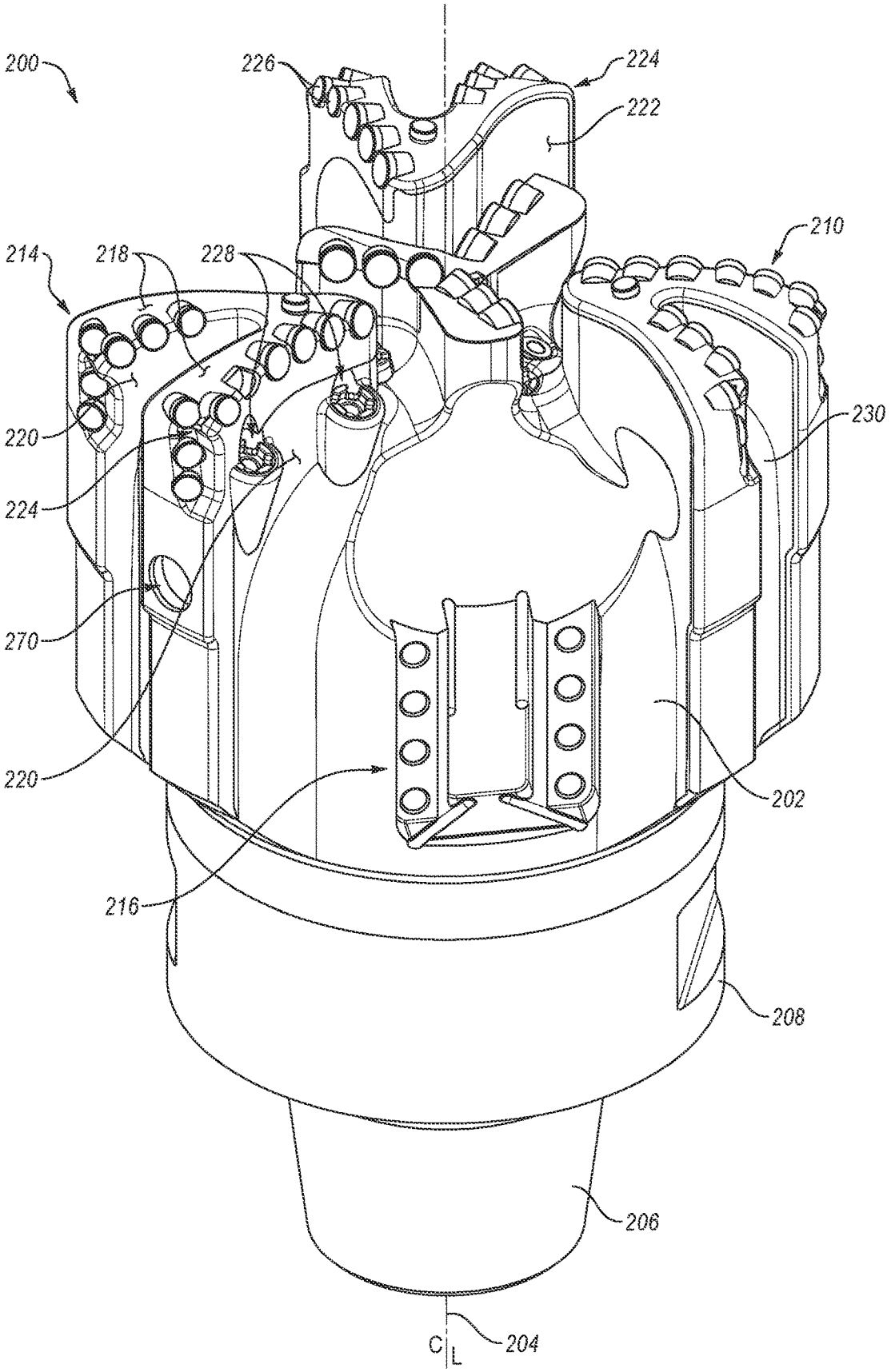
FIG. 2A is a perspective view of an earth-boring tool that may be used with the drilling assembly of FIG. 1 according to one or more embodiments of the present disclosure.

FIG. 2A shows a perspective view an earth-boring tool 200 having hydraulic features according to embodiments of the present disclosure that may be utilized with the drilling assembly 114 of FIG. 1. Although a hybrid bit is shown and described in some embodiments, it will be understood that other types of earth-boring tools, such as percussion bits, drag bits, reamers, etc., may also include hydraulic passages according to additional embodiments of the present disclosure.

The earth-boring tool 200 may include a body 202 including a pin 206, a shank 208, and a crown 210. In some embodiments, the bulk of the body 202 may be constructed of steel, or of a ceramic-metal composite material including particles of hard material (e.g., tungsten carbide) cemented within a metal matrix material. The body 202 of the earth-boring tool 200 may have an axial center defining a center longitudinal axis 204 that may generally coincide with a rotational axis of the earth-boring tool 200. The center longitudinal axis 204 of the body 202 may extend in a direction hereinafter referred to as an "axial direction."

The body 202 may be configured to connect to a drill string 110 (FIG. 1). For example, the pin 206 of the body 202 may have a tapered upper end having threads thereon for connecting the earth-boring tool 200 to a box end of a drilling assembly 114 (FIG. 1). The shank 208 may be coupled to the crown 210 at a joint.

The crown 210 may include a plurality of blades 214, and may include receptacles 216 configured for coupling roller cone elements (not shown) thereto. For example, the receptacles 216 may be configured to affix mechanically attached roller cone elements such as described in U.S. Pat. No. 10,107,039 to Schroder, issued Oct. 23, 2018, and titled "HYBRID BIT WITH MECHANICALLY ATTACHED ROLLER CONE ELEMENTS," the specification of which is incorporated herein in its entirety by this reference.

Each blade 214 of the plurality of blades 214 of the earth-boring tool 200 may include a face surface 218, a rotationally leading surface 220, and a rotationally trailing surface 222. The face surface 218 may be positioned and configured to interface a formation at the bottom of a borehole during drilling operations. The face surface 218 may be oriented substantially parallel to an intended rotational direction of the earth-boring tool 200 during drilling operations. The rotationally leading surface 220, and the rotationally trailing surface 222, may be oriented substantially perpendicular to the intended rotational direction of the earth-boring tool 200 during drilling operations.

A cutting edge 224 may be located at an interface between the face surface 218 and the rotationally leading surface 220, and may include a plurality of cutting elements 226 fixed therein. The plurality of cutting elements 226 of each blade 214 may be located in a row along a profile of the blade 214 proximate the rotationally leading surface 220 of the blade 214. In some embodiments, the plurality of cutting elements 226 of the plurality of blades 214 may include PDC cutting elements 226.

The earth-boring tool 200 may include at least one fluid port 228 extending through at least one blade 214. In some embodiments, the earth-boring tool 200 may include a plurality of fluid ports 228 extending through a blade. The positioning of fluid ports 228 through the blade 214 may provide fluid openings located proximate to the cutting edge 224 of the blade 214, which may provide superior cooling and cleaning of the cutting edge 224 during drilling operations when compared to fluid ports located at the bottom of junk slots 230 and distal from the cutting edge 224.

Figure 2B:
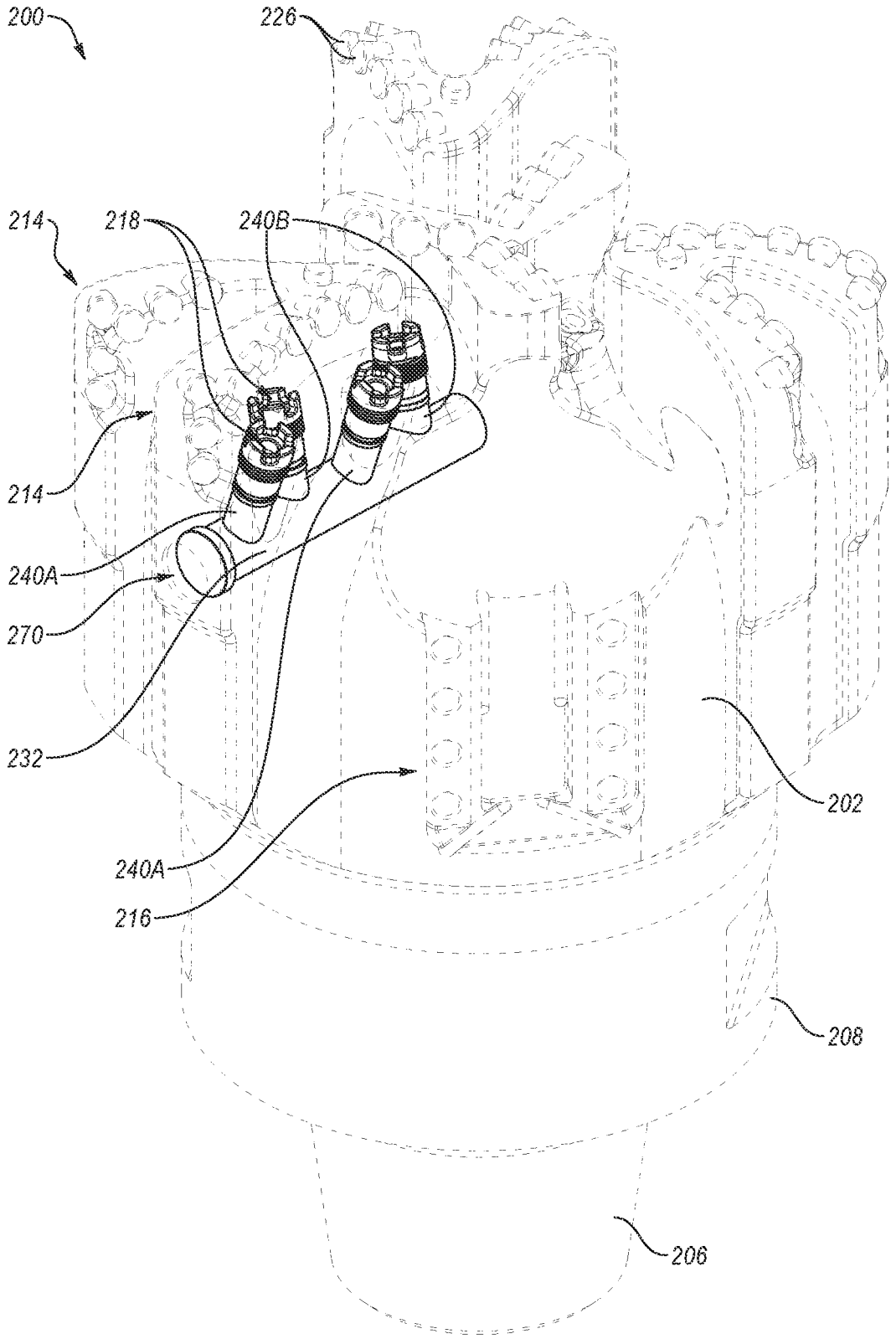
FIG. 2B is a partially transparent perspective view of the earth-boring tool of FIG. 2A showing internal components.
Figure 2C:
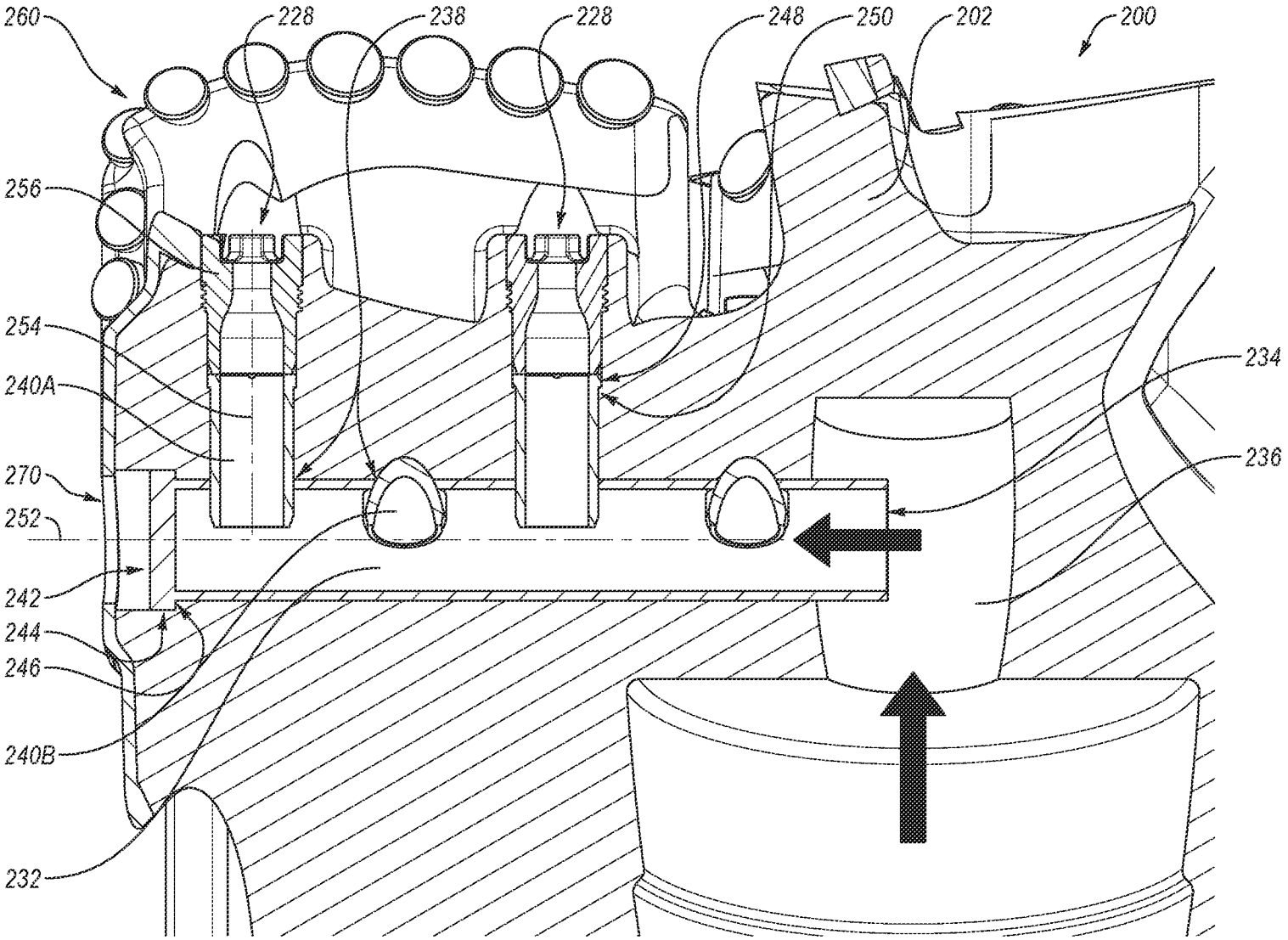
FIG. 2C is a detail cross-sectional view of a blade portion of the earth-boring tool of FIG. 2A.

As shown in FIGS. 2B and 2C, a fluid port manifold 232 may be a substantially straight tubular structure positioned within an opening 270 in the body 202 of the earth-boring tool 200. The fluid port manifold 232 may have an opening 234 at a first end in fluid communication with a primary fluid passage 236 (see FIG. 2C) of the earth-boring tool 200. A plurality of openings 238 may be provided along a length of the fluid port manifold 232, and a fluid port sleeve 240A, 240B may extend into each opening 238. The fluid port sleeves 240A, 240B may be positioned within the fluid ports 228. Accordingly, the fluid port manifold 232 may provide fluid communication between each of the fluid port sleeves 240A, 240B and the primary fluid passage 236 of the earth-boring tool 200.

The fluid port manifold 232 may be a substantially straight tubular structure having the opening 234 at the first end. In some embodiments, the fluid port manifold 232 may have an enclosed and sealed second end 242, opposite the first end. In further embodiments, the fluid port manifold 232 may have an open second end 242, and an external seal may be installed on the body 202 of the earth-boring tool 200. The second end 242 may additionally include a flange 244, which may be positioned against a seat 246 in the body 202 of the earth-boring tool 200 to facilitate proper positioning of the fluid port manifold 232 in the body 202. The length and inner diameter of the fluid port manifold 232 may vary depending on factors such as the size of the earth-boring tool 200 and the number of blades 214 on the body 202 of the earth-boring tool 200. As a non-limiting example, the length of the fluid port manifold 232 may be between about 0.5 inch (1.27 cm) and about 18 inches (45.72 cm). As another non-limiting example, the inner diameter of the fluid port manifold 232 may be between about 0.25 inch (0.635 cm) and about 4 inches (10.16 cm).

Each of the fluid port sleeves 240A, 240B may also be a substantially straight tubular structure, and may have an opening at each of a first end and an opposing second end. Like the fluid port manifold 232, the second end of each of the fluid port sleeves 240A, 240B may include a flange 248, which may be positioned against a seat 250 in the body 202 of the earth-boring tool 200 to facilitate proper positioning of the fluid port sleeve 240A, 240B in the body 202. The length and inner diameter of the fluid port sleeves 240A, 240B may vary depending on factors such as the size of the earth-boring tool 200 and the number of blades 214 on the body 202 of the earth-boring tool 200. As a non-limiting example, the length of the fluid port sleeves 240A, 240B may be between about 0.5 inch (1.27 cm) and about 18 inches (45.72 cm). As another non-limiting example, the inner diameter of the fluid port sleeves 240A, 240B may be between about 0.25 inch (0.635 cm) and about 4 inches (10.16 cm).

The fluid port manifold 232, and each fluid port sleeve 240A, 240B may be comprised of a wear resistant material, such as a ceramic material, or a ceramic-metal matrix composite material. For example, the fluid port manifold 232, and each fluid port sleeve 240A, 240B may be made comprised of silicon carbide, or cobalt-cemented tungsten carbide. Additionally, the fluid port manifold 232, and each fluid port sleeve 240A, 240B may be brazed to the body 202. Accordingly, the fluid port manifold 232 and the fluid port sleeves 240 A, 240B may provide erosion and abrasion protection to the body 202 of the earth-boring tool 200 from fluid, which may contain abrasive particles suspended therein, being directed therethrough.

Each fluid port sleeve 240A, 240B may have a length extending from the fluid port manifold 232. In some embodiments, the length of each fluid port sleeve 240A, 240B may be substantially the same, such as shown in FIGS. 2B and 2C. In additional embodiments, the fluid port sleeves 240A, 240B may be of various lengths (see FIG. 3B). For example, a first fluid port sleeve of the plurality of fluid port sleeves 240A, 240B may have a longitudinal length that is different than a longitudinal length of a second fluid port sleeve of the plurality of fluid port sleeves 240A, 240B.

The fluid port manifold 232 may extend along a primary axis 252, and each of the fluid port sleeves 240A, 240B may extend upon a respective primary axis 254. In some embodiments, the primary axis 254 of each of the fluid port sleeves 240A, 240B may be oriented at substantially the same angle relative to the primary axis 252 of the fluid port manifold, as shown in FIG. 2C. In additional embodiments, the primary axis 254 of the fluid port sleeves 240A, 240B may be oriented at different angles relative to the primary axis 252 of the fluid port manifold 232. For example, a primary axis 254 of a first fluid port sleeve of the plurality of fluid port sleeves 240A, 240B may be oriented at a first angle relative to the primary axis 252 of the fluid port manifold 232 and the primary axis 254 of a second fluid port sleeve of the plurality of fluid port sleeves 240A, 240B may be oriented at a second angle relative to the primary axis 252 of the fluid port manifold 232, the second angle being different than the first angle.

Additionally, the fluid port sleeves 240A, 240B may be oriented at specific radial orientations relative to the primary axis 252 of the fluid port manifold 232. In some embodiments, some or all of the fluid port sleeves 240A, 240B may be oriented at the same radial orientation relative to the primary axis 252 of the fluid port manifold 232. For example, as shown in FIGS. 2B and 2C, the fluid port sleeves 240A may be oriented at the same radial orientation relative to the primary axis 252 of the fluid port manifold 232. Additionally, as shown in FIG. 2C, a primary axis 254 of the fluid port sleeves 240A may be oriented at a first radial orientation relative to the primary axis 252 of the fluid port manifold 232 and the primary axis 254 of the fluid port sleeves 240B may be oriented at a second radial orientation relative to the primary axis 252 of the fluid port manifold 232, the second radial orientation being different than the first radial orientation.

As a non-limiting example, the orientation of the primary axis 254 of a fluid port sleeve 240A, 240B relative to the primary axis 252 of the fluid port manifold 232 may vary from perpendicular in any direction (e.g., tilt or rotation) by about 60 degrees.

In addition to a fluid port sleeve 240A, 240B, one or more of the fluid ports 228 may be configured to also receive a nozzle 256. As shown in FIG. 2C, a nozzle 256 may threaded into a threaded coupling formed in the fluid port 228 and be positioned adjacent a fluid port sleeve 240A, 240B within the fluid port 228. The nozzle 256 may be configured to modify the flow pattern exiting the fluid port 228, and may be replaceable with relative ease to change the flow configuration and/or to replace a nozzle 256 that has become damaged.

In some embodiments, at least one of the fluid ports 228 may extend through the rotationally leading surface 220 of at least one blade 214, as shown in FIGS. 2A and 2B. Additionally, in some embodiments, at least one of the fluid ports 228 may extend through the rotationally trailing surface 222 of at least one blade 214, as shown in FIG. 2B.

By providing fluid ports 228 extending through the blade 214, the exits of the fluid ports 228 may be positioned closer to the cutting edge 224 of the blade 214 and provide improved cooling and cleaning. For example, areas of the blade 214 that may experience extensive heat and abrasion, such as a shoulder area 260 (see FIG. 2C) of the blade 214, may have fluid directed more effectively to the area to provide cooling and cleaning of the area during drilling operations.

Figure 3A:
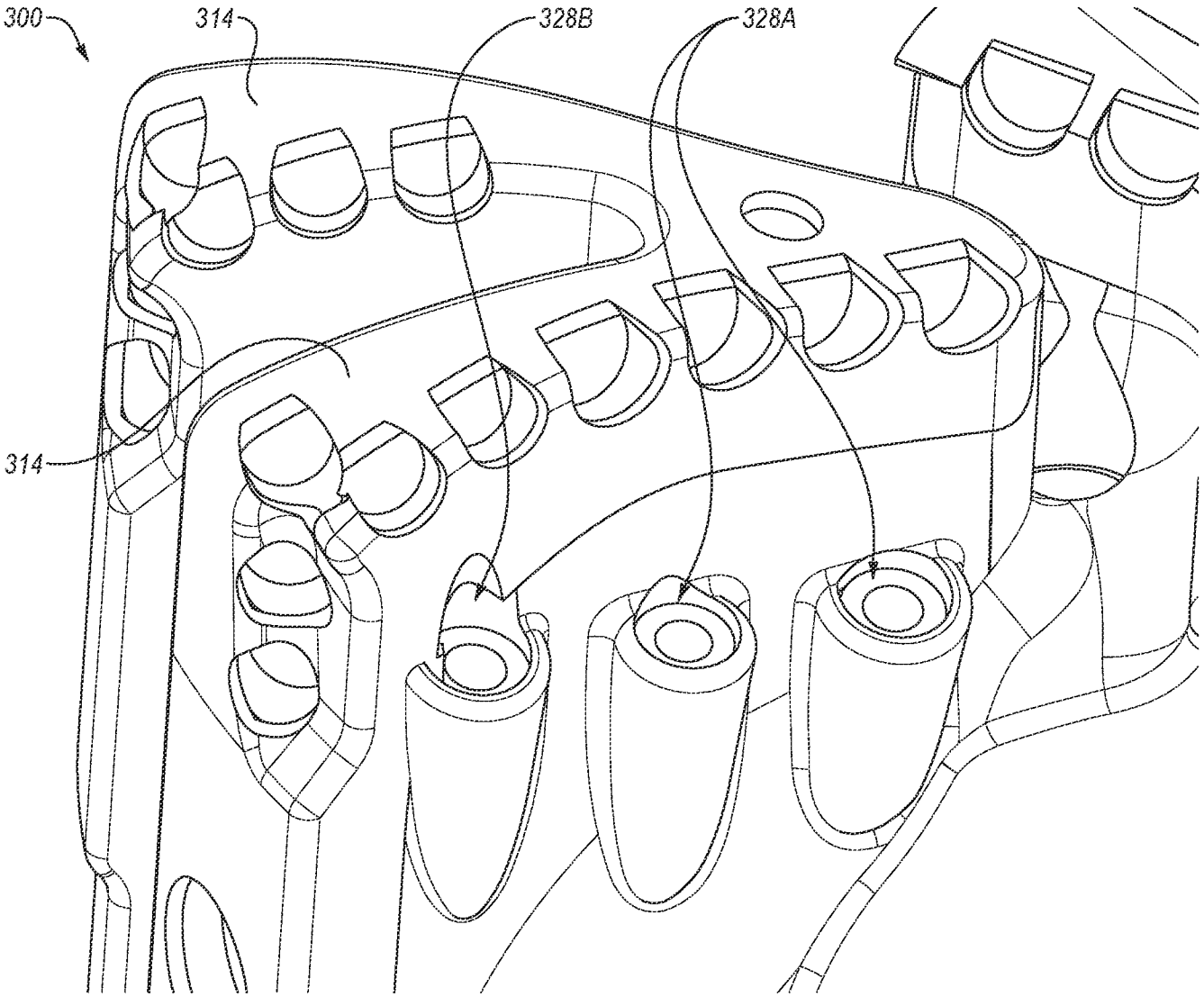
FIG. 3A is a detail perspective view of another earth-boring tool that may be used with the drilling assembly of FIG. 1 according to one or more additional embodiments of the present disclosure.
Figure 3B:
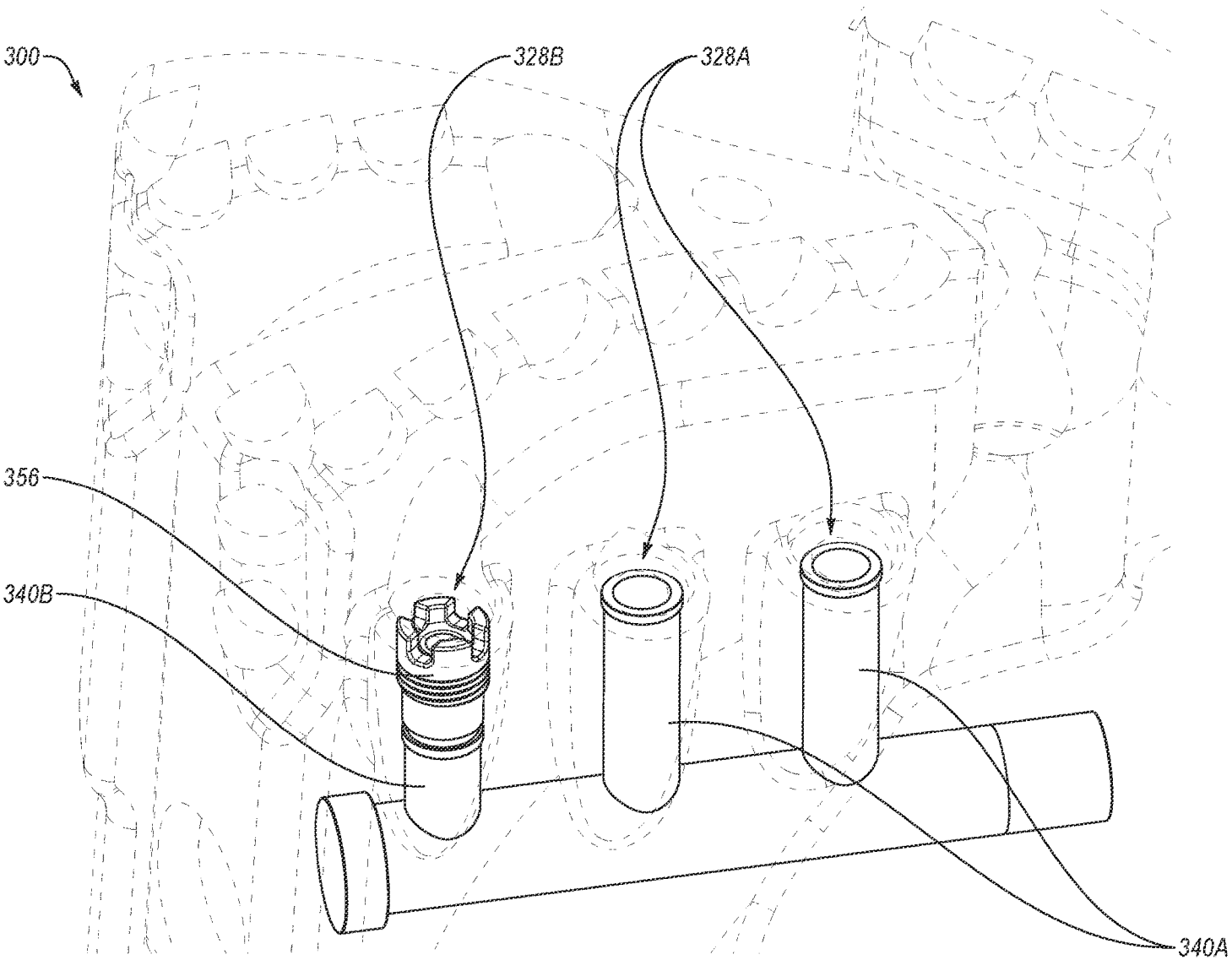
FIG. 3B is a partially transparent detail perspective view of the earth-boring tool of FIG. 3A showing internal components.

In some embodiments, such as shown in FIGS. 3A and 3B, an earth-boring tool 300 may include one or more fluid ports 328A extending through at least one blade 314 that may include a fluid port sleeve 340A that may extend along all, or at least a majority, of the length of the fluid port 328A, and may not include a nozzle therein. One or more additional fluid port 328B may be sized to include both a fluid port sleeve 340B and a nozzle 356.

Referring again to FIG. 2C, in operation, fluid may be directed into a primary fluid passage 236 of the earth-boring tool 200 from a drill string 110. The fluid may then be directed into the opening 234 at the first end of the fluid port manifold 232. From the fluid port manifold 232, the fluid may be directed through each of the fluid port sleeves 240A, 240B, and through the blade 214 of the earth-boring tool 200. The fluid exiting the rotationally leading surface 220 of the blade 214 of the earth-boring tool 200 may then be directed toward the cutting edge 224 of the blade 214. If the fluid port 228 is configured to direct fluid through the rotationally trailing surface 222 of the blade 214, the fluid may be directed toward the cutting edge 224 of a rotationally trailing blade 214.

Referring again to FIGS. 2A-2C, a method of forming an earth-boring tool 200 as shown in the embodiments described above is now discussed. The method of forming an earth-boring tool 200 includes providing a body 202 (such as, for example, a steel bit body) including an opening 270 extending from an outer surface of the body 202 to a primary fluid passage 236. The opening 270 may formed by machining operations (e.g., drilling and/or milling) or may be formed by other manufacturing techniques, such as by molding, or additive manufacturing techniques. The body 202 may additionally be provided with fluid ports 228 extending through the blade 214 to the opening 270. The fluid ports 228 may be formed similarly to the opening 270.

The fluid port manifold 232 may be inserted into the opening, and the flange 244 of the fluid port manifold 232 may be seated in the opening 270. Optionally, an external seal (not shown) may be installed in the opening 270 after insertion of the fluid port manifold 232. The openings 238 extending along the length of the fluid port manifold 232 may be aligned with the fluid ports 228 in the body 202. The fluid port sleeves 240A, 240B may then be inserted into the fluid ports 228 in the body 202 and the first end of each fluid port sleeve 240A, 240B may be inserted into a respective opening 238 in the fluid port manifold 232. The flange 248 at the second end of each fluid port sleeve 240A, 240B may be seated in each respective fluid port 228. The fluid port manifold 232 and each of the fluid port sleeves 240A, 240B may then be coupled to the body 202 of the earth-boring tool 200, such as by brazing, epoxy, and/or threaded retention. In some embodiments, one or more nozzle 256 may then be disposed into one or more fluid port 228 adjacent a fluid port sleeve 240A, 240B.

Additional non-limiting example embodiments of the disclosure are described below.

Embodiment 1: An earth-boring tool comprising at least one blade having a face surface, at least one fluid port extending through the at least one blade, and a fluid port manifold having an opening at a first end and a plurality of openings along a length providing fluid communication between the at least one fluid port and a primary fluid passage of the earth-boring tool.

Embodiment 2: The earth-boring tool of embodiment 1, wherein the at least one fluid port comprises a plurality of fluid ports.

Embodiment 3: The earth-boring tool of embodiment 2, further comprising a plurality of fluid port sleeves, each of the plurality of fluid port sleeves positioned within a corresponding fluid port of the plurality of fluid ports.

Embodiment 4: The earth-boring tool of embodiment 3, further comprising a fluid port manifold providing fluid communication between each of the plurality of fluid port sleeves and a primary fluid passage.

Embodiment 5: The earth-boring tool of any of embodiments 2 through 4, wherein a first fluid port sleeve of the plurality of fluid port sleeves has a longitudinal length that is different than a longitudinal length of a second fluid port sleeve of the plurality of fluid port sleeves.

Embodiment 6: The earth-boring tool of any of embodiments 2 through 5, wherein a primary axis of a first fluid port sleeve of the plurality of fluid port sleeves is oriented at a first angle relative to a primary axis of the fluid port manifold and a primary axis of a second fluid port sleeve of the plurality of fluid port sleeves is oriented at a second angle relative to the primary axis of the fluid port manifold, the second angle being different than the first angle.

Embodiment 7: The earth-boring tool of any of embodiments 2 through 6, wherein a primary axis of a first fluid port sleeve of the plurality of fluid port sleeves is oriented at a first radial orientation relative to a primary axis of the fluid port manifold and a primary axis of a second fluid port sleeve of the plurality of fluid port sleeves is oriented at a second radial orientation relative to the primary axis of the fluid port manifold, the second radial orientation being different than the first radial orientation.

Embodiment 8: The earth-boring tool of any of embodiments 2 through 7, further comprising a nozzle positioned in at least one fluid port of the plurality of fluid ports.

Embodiment 9: The earth-boring tool of any of embodiments 2 through 8, wherein the fluid port manifold, and each fluid port sleeve is comprised of a ceramic material.

Embodiment 10: The earth-boring tool of any of embodiments 2 through 9, wherein the fluid port manifold, and each fluid port sleeve is comprised of silicon carbide.

Embodiment 11: The earth-boring tool of any of embodiments 2 through 10, wherein the fluid port manifold, and each fluid port sleeve is brazed to the tool body.

Embodiment 12: The earth-boring tool of any of embodiments 1 through 11, wherein the at least one fluid port extends through the rotationally leading surface of the at least one blade.

Embodiment 13: The earth-boring tool of any of embodiments 1 through 11, wherein the rotationally leading surface of the at least one blade comprises a surface oriented substantially perpendicular to an intended direction of rotation.

Embodiment 14: The earth-boring tool of any of embodiments 1 through 13, wherein the at least one blade further comprises a rotationally trailing surface, and wherein the at least one fluid port extends through the rotationally trailing surface of the at least one blade.

Embodiment 15: An earth-boring tool, comprising a tool body; at least one fluid port manifold located in the tool body and having an opening at a first end in fluid communication with a primary fluid passage, and a plurality of openings along a length of the at least one fluid port manifold; and a plurality of fluid port sleeves, each fluid port sleeve of the plurality of fluid port sleeves extending into a corresponding opening of the plurality of openings along the length of the at least one fluid port manifold.

Embodiment 16: The earth-boring tool of embodiment 15, wherein a second end of the at least one fluid port manifold, opposite the first end, is sealed.

Embodiment 17: The earth-boring tool of embodiment 15, wherein a second end of the at least one fluid port manifold, opposite the first end, is open.

Embodiment 18: A method of forming an earth-boring tool, the method comprising: disposing a fluid port manifold within an opening of a body of the earth-boring tool, the opening extending from an outer surface of the body to a primary fluid passage; and disposing at least one fluid port sleeve within at least one fluid port, the at least one fluid port extending through a blade of the body to an opening in the fluid port manifold.

Embodiment 19: The method of embodiment 18, further comprising brazing each of the fluid port manifold and the at least one fluid port sleeve to the body of the earth-boring tool.

Embodiment 20: The method of embodiment 18 or 19, further comprising disposing at least one nozzle within the at least one fluid port, adjacent the at least one fluid port sleeve.

While the disclosed device structures and methods are susceptible to various modifications and alternative forms in implementation thereof, specific embodiments have been shown by way of example in the drawings and have been described in detail herein. However, it should be understood that the present disclosure is not limited to the particular forms disclosed. Rather, the present invention encompasses all modifications, combinations, equivalents, variations, and alternatives falling within the scope of the present disclosure as defined by the following appended claims and their legal equivalents.

What is claimed is:

1. An earth-boring tool, comprising:

a tool body comprising at least one blade having a face surface, a cutting edge, and a rotationally leading surface;

a plurality of cutting elements located on the at least one blade;

at least one fluid port extending through the at least one blade and located proximate to the cutting edge;

a fluid port manifold located within and coupled to the tool body, the fluid port manifold having an opening at a first end and a plurality of openings along a longitudinal length providing fluid communication between the at least one fluid port and a primary fluid passage of the earth-boring tool;

a plurality of fluid port sleeves located within and coupled to the tool body, each of the plurality of fluid port sleeves positioned within a corresponding fluid port, and each of the plurality of fluid port sleeves extending into a corresponding opening of the plurality of openings of the fluid port manifold; and a nozzle positioned within the corresponding fluid port.

2. The earth-boring tool of claim 1, wherein the at least one fluid port comprises a plurality of fluid ports.

3. The earth-boring tool of claim 2, wherein a first fluid port sleeve of the plurality of fluid port sleeves has a longitudinal length that is different than a longitudinal length of a second fluid port sleeve of the plurality of fluid port sleeves.

4. The earth-boring tool of claim 2, wherein a primary axis of a first fluid port sleeve of the plurality of fluid port sleeves is oriented at a first angle relative to a primary axis of the fluid port manifold and a primary axis of a second fluid port sleeve of the plurality of fluid port sleeves is oriented at a second angle relative to the primary axis of the fluid port manifold, the second angle being different than the first angle.

5. The earth-boring tool of claim 2, wherein a primary axis of a first fluid port sleeve of the plurality of fluid port sleeves is oriented at a first radial orientation relative to a primary axis of the fluid port manifold and a primary axis of a second fluid port sleeve of the plurality of fluid port sleeves is oriented at a second radial orientation relative to the primary axis of the fluid port manifold, the second radial orientation being different than the first radial orientation.

6. The earth-boring tool of claim 1, wherein the fluid port manifold provides fluid communication between each of the plurality of fluid port sleeves and the primary fluid passage.

7. The earth-boring tool of claim 1, wherein the fluid port manifold, and each fluid port sleeve is comprised of a ceramic material.

8. The earth-boring tool of claim 1, wherein the fluid port manifold, and each fluid port sleeve is comprised of silicon carbide.

9. The earth-boring tool of claim 1, wherein the fluid port manifold, and each fluid port sleeve is brazed to the tool body.

10. The earth-boring tool of claim 1, wherein the at least one fluid port extends through the rotationally leading surface of the at least one blade.

11. The earth-boring tool of claim 10, wherein the rotationally leading surface of the at least one blade comprises a surface oriented substantially perpendicular to an intended direction of rotation.

12. The earth-boring tool of claim 1, wherein the at least one blade further comprises a rotationally trailing surface, and wherein the at least one fluid port extends through the rotationally trailing surface of the at least one blade.

13. The earth-boring tool of claim 1, wherein the fluid port manifold comprises a substantially straight tubular structure.

14. The earth-boring tool of claim 1, wherein at least a portion of the fluid port manifold extends within the at least one blade.

15. The earth-boring tool of claim 1, wherein a longitudinal axis of the fluid port manifold extends substantially perpendicular to a center longitudinal axis of the tool body.

16. The earth-boring tool of claim 1, wherein the primary fluid passage extends in an axial direction through the tool body, and the longitudinal length of the fluid port manifold extends radially through the tool body.

17. The earth-boring tool of claim 1, wherein the plurality of openings along the longitudinal length of the fluid port manifold are individually aligned with a corresponding fluid port of the at least one fluid port.

18. An earth-boring tool, comprising:

a tool body;

blades extending longitudinally and generally radially from the tool body;

a plurality of cutting elements located on each blade;

at least one fluid port manifold located within and coupled to the tool body, the at least one fluid port manifold having an opening at a first end in fluid communication with a primary fluid passage, and a plurality of openings along a longitudinal length of the at least one fluid port manifold;

at least one fluid port extending through one of the blades and located proximate to a cutting edge thereof;

a plurality of fluid port sleeves, each fluid port sleeve of the plurality of fluid port sleeves extending into a corresponding opening of the plurality of openings along the longitudinal length of the at least one fluid port manifold, the plurality of fluid port sleeves in fluid communication with the primary fluid passage by way of the at least one fluid port manifold; and a nozzle positioned within a corresponding fluid port.

19. The earth-boring tool of claim 18, wherein a second end of the at least one fluid port manifold, opposite the first end, is sealed.

20. The earth-boring tool of claim 18, wherein a second end of the at least one fluid port manifold, opposite the first end, is open.

21. A method of forming an earth-boring tool, the method comprising:

disposing a fluid port manifold within an opening of a body of the earth-boring tool, the opening extending from an outer surface of the body to a primary fluid passage;

disposing at least one fluid port sleeve within at least one fluid port, the at least one fluid port extending through a blade of the body to an opening in the fluid port manifold, the at least one fluid port located proximate to a cutting edge of the blade, and the blade comprising a plurality of cutting elements;

coupling the fluid port manifold and the at least one fluid port sleeve to the body of the earth-boring tool, a plurality of openings along a longitudinal length of the fluid port manifold providing fluid communication between the at least one fluid port and the primary fluid passage, the at least one fluid port sleeve extending into a corresponding opening of the plurality of openings of the fluid port manifold; and disposing at least one nozzle within the at least one fluid port, adjacent the at least one fluid port sleeve.

22. The method of claim 21, wherein coupling the fluid port manifold and the at least one fluid port sleeve to the body of the earth-boring tool comprises brazing each of the fluid port manifold and the at least one fluid port sleeve to the body of the earth-boring tool.

23. The method of claim 21, wherein disposing the at least one nozzle within the at least one fluid port comprises longitudinal end surfaces of the at least one nozzle distal from the cutting edge of the blade abutting longitudinal end surfaces of the at least one fluid port sleeve proximate to the cutting edge of the blade.

24. The method of claim 21, wherein disposing the fluid port manifold within the opening of the body of the earth-boring tool comprises positioning a flange of the fluid port manifold against a seat in the body of the earth-boring tool.

* * * * *